US007108069B2

(12) United States Patent
Killie et al.

(10) Patent No.: US 7,108,069 B2
(45) Date of Patent: Sep. 19, 2006

(54) ONLINE THERMAL AND WATERCUT MANAGEMENT

(75) Inventors: Rune Killie, Houston, TX (US); John Allen, Houston, TX (US)

(73) Assignee: Offshore Systems, Inc., Houston, TX (US)

( * ) Notice: Subject to any disclaimer, the term of this patent is extended or adjusted under 35 U.S.C. 154(b) by 256 days.

(21) Appl. No.: 10/831,480

(22) Filed: Apr. 23, 2004

(65) Prior Publication Data

US 2005/0236155 A1 Oct. 27, 2005

(51) Int. Cl.
*E21B 34/04* (2006.01)
*E21B 43/017* (2006.01)

(52) U.S. Cl. ..... 166/336; 166/366; 166/344; 340/853.3; 702/12

(58) Field of Classification Search ..... 166/336, 166/366, 344; 702/12, 13; 340/853.2, 853.3
See application file for complete search history.

(56) References Cited

U.S. PATENT DOCUMENTS 3,629,859 A * 12/1971 Copland et al. ..... 702/188
4,378,848 A * 4/1983 Milberger ..... 166/351
4,702,321 A 10/1987 Horton
4,757,314 A 7/1988 Aubin et al.
5,394,339 A * 2/1995 Jones ..... 702/12
5,576,974 A * 11/1996 Marrelli et al. ..... 702/179
6,059,039 A 5/2000 Bednar et al.
6,079,498 A 6/2000 Lima et al.
6,266,619 B1 * 7/2001 Thomas et al. ..... 702/13
6,454,002 B1 * 9/2002 Stokes et al. ..... 166/250.15
6,564,872 B1 * 5/2003 Davey et al. ..... 166/344
6,772,082 B1 * 8/2004 van der Geest et al. .... 702/116
2003/0005747 A1 1/2003 van der Geest et al.
2004/0200615 A1 * 10/2004 Wilde ..... 166/250.15

* cited by examiner

*Primary Examiner*—David Bagnell
*Assistant Examiner*—Shane Bomar
(74) *Attorney, Agent, or Firm*—Bracewell & Guiliani LLP

(57) ABSTRACT

A system, method, and software for optimizing the commingling of well fluids from a plurality of producing subsea wells. The mixing temperature and water content in each header of a collection manifold are calculated for each subsea well and header combinations, responsive to data from sensors at the collection manifold. Combinations with conditions outside operational limits are then discarded. Remaining combinations are ranked based on predetermined optimization criteria. The ranked combinations are provided for the operator for optimizing flow properties and well fluid production. The calculations can restart with new, real-time sensed values from the subsea collection manifold.

30 Claims, 6 Drawing Sheets

ONLINE THERMAL AND WATERCUT MANAGEMENT

BACKGROUND OF THE INVENTION

1. Field of the Invention

This invention relates in general to subsea well installations and in particular to a method of managing production from a plurality of subsea wells.

2. Background of the Invention

In a subsea oil field it is common practice to drill a plurality or cluster of subsea wells for the more efficient production of well fluid from an oil field. The well fluid typically contains water, hydrocarbon gas (gas), and hydrocarbon liquid (oil). A subsea collection manifold is sometimes used to collect the well fluid from each of the plurality of subsea wells rather than transporting the well fluid from each of the individual wells to the surface. From the collection manifold, a common riser can transport the well fluid from all of the subsea wells to a vessel at the surface of the sea.

In other situations, a riser extends from each subsea well to a vessel or platform at the surface. The well fluid from each of the wells is then transported through a common conduit to a floating production storage and offloading (FPSO) vessel located away from the platform. In this situation, the well fluid from each of the subsea wells commingle in a collection manifold located topside, on the platform, and are then pumped down to the FPSO. The conduit typically extends from the platform, along the subsea surface, and then back up to the FPSO.

In both situations, the well fluid from each of the subsea wells are commingled in a collection manifold, and then conveyed through a common riser or conduit. When multiple inflows are merged into a smaller number of outflows at a commingling point in a converging production network, the resulting mixing temperature and mixing watercut or water content in each outflow depend on how the inflows are combined. An optimum or desired combination is sometimes determined by mixing temperatures and/or water cuts. For example, an optimum or desired combination could be one that gives the highest mixing temperature in the coldest outflow in order to minimize wax or hydrate problems, or one that ensures a water cut far away from the inversion point in each outflow in order to minimize emulsion problems. In other words, in various situations, the desired or optimized mixing temperature and water content of the mixing well fluid can vary based on the situation, and the operating conditions.

The number of possible combinations can be extremely large. With n inflows and k outflows, where each inflow can be routed to any outflow, the total number N of possible combinations is given as $$N=k^n$$

For example, with 20 inflows and 4 outflows, there are more than a trillion combinations. Trying to optimize the commingling by trial and error or offline hand calculations can therefore be cumbersome. Furthermore, flow conditions change continuously and offline calculations based on flow rates measured in the last well tests might become inaccurate, in particular if key events, like water breakthrough, have occurred after the last well tests.

SUMMARY OF THE INVENTION

A system manages production of well fluid from the collection manifold receiving well fluid from a plurality of subsea wells. The system includes calculator software, which determines selected flow rate of well fluid from each of the plurality of subsea wells in order to achieve desired temperatures and water content of the well fluid exiting the collection manifold. The calculator software calculates the selected flow rates by comparing a calculated mixing temperature and a water content of the well fluids collecting in the collection manifold. The calculated mixing temperature and water contents are responsive to a paired combination selected from of the inlet pressure, temperature, and flow rate of the well fluid entering the collection manifold from each of the plurality of subsea wells. The operator has provided a desirous, predetermined water content and a desirous temperature for the well fluid exiting the collection manifold for the calculator software to attempt to achieve.

The system includes a pressure sensor that communicates with the calculator software. The pressure sensor is positioned between the well fluid output of each of the plurality of subsea wells and the collection manifold. The pressure sensor senses the well fluid pressure of the well fluid before entering the collection manifold and commingling with well fluid from other subsea wells. The system includes a temperature sensor that also communicates with the calculator software. The temperature sensor is positioned between the well fluid output of each of the plurality of subsea wells. The temperature sensor senses the well fluid temperature of the well fluid before entering the collection manifold and commingling with the well fluid from other subsea wells by selectively actuating the flow control valves. Alternatively, the system can include a flow meter in place of either the pressure sensor or the temperature sensor.

The system further includes flow control valves positioned between each of the plurality of wells and the collection manifold. The flow control valves control the flow rate of the well fluid entering the collection manifold. The system also includes a controller. The controller selectively controls the flow rate of the well fluid entering the collection manifold from each of the plurality of subsea wells.

Another aspect of the present invention additionally provides a software located on a server. The software manages well fluid production from plurality of subsea wells feeding into a subsea collection manifold through a plurality of control valves. The software regulates the flow of the well fluid from each of the plurality of subsea wells. The software includes an operating conditions calculator to calculate a plurality of predetermined individual well fluid properties of the well fluid from each of the plurality of subsea wells. The conditions calculator also calculates a plurality of well fluid properties of a mixture well fluid commingling in the collection manifold when the well fluid from each of the plurality of subsea wells enters the collection manifold. The software further includes a flow rate determiner to determine selected flow rates of well fluid from each of the plurality of subsea wells. The software determines selected flow rates responsive to comparing the properties of the mixture of cumulative well fluid in the collection manifold and a predetermined set of values for well fluids exiting the collection manifold entered by an operator.

A method or process for optimizing the commingling of well fluids from a plurality of producing subsea wells. If the number of well combinations is too large for the central processing unit of the server, the number of subsea well (with its associated production lines) and header combinations subject to analysis are reduced by specifying a minimum and/or maximum number of wells to each header. With the reduced list of subsea well and header combinations, the mixing temperature and water cut in each header of the collection manifold are calculated for each subsea well and header combinations. The calculations are based on data from sensors at the collection manifold and production lines and flow monitoring software. Subsea well and header combinations that give conditions outside operational limits specified by the operator are then discarded. As an example, the velocity in each header must be below the erosional velocity.

All well combinations that have not been discarded are then ranked based on optimization criteria defined by the operator. The calculations will restart and the software can then account for subsea wells that were initially reduced in step one due to the calculating capacity of the central processing unit of the server. The process is repeated until all subsea wells have been included in the calculations.

By comparing the current valve settings with the ranked list of possible well combinations, it can be detected if the current combination is not desired. In that case, the operator can manually switch the valves, or the valves can be switched automatically. For automatic switching, the new valve settings are automatically fed back into the software and taken into account in the next calculation loop. The software communicates the valve settings for the achieving the combination to a controller, which can then actuate the valve automatically.

The process can then be repeated online to account for changes in operating conditions that may occur after the valves are actuated. The process can wait until the operator initiates the process again, the process can be set to repeat after a desired interval of time, or the process can run continuously. When the process begins again, the entire process starts over based upon more current measurements from the sensors.

BRIEF DESCRIPTION OF THE DRAWINGS

Some of the features, advantages, and benefits of the present invention having been stated, others will become apparent as the description proceeds when taken in conjunction with the accompanying drawings in which.

DETAILED DESCRIPTION OF THE PREFERRED EMBODIMENT

Figure 1:
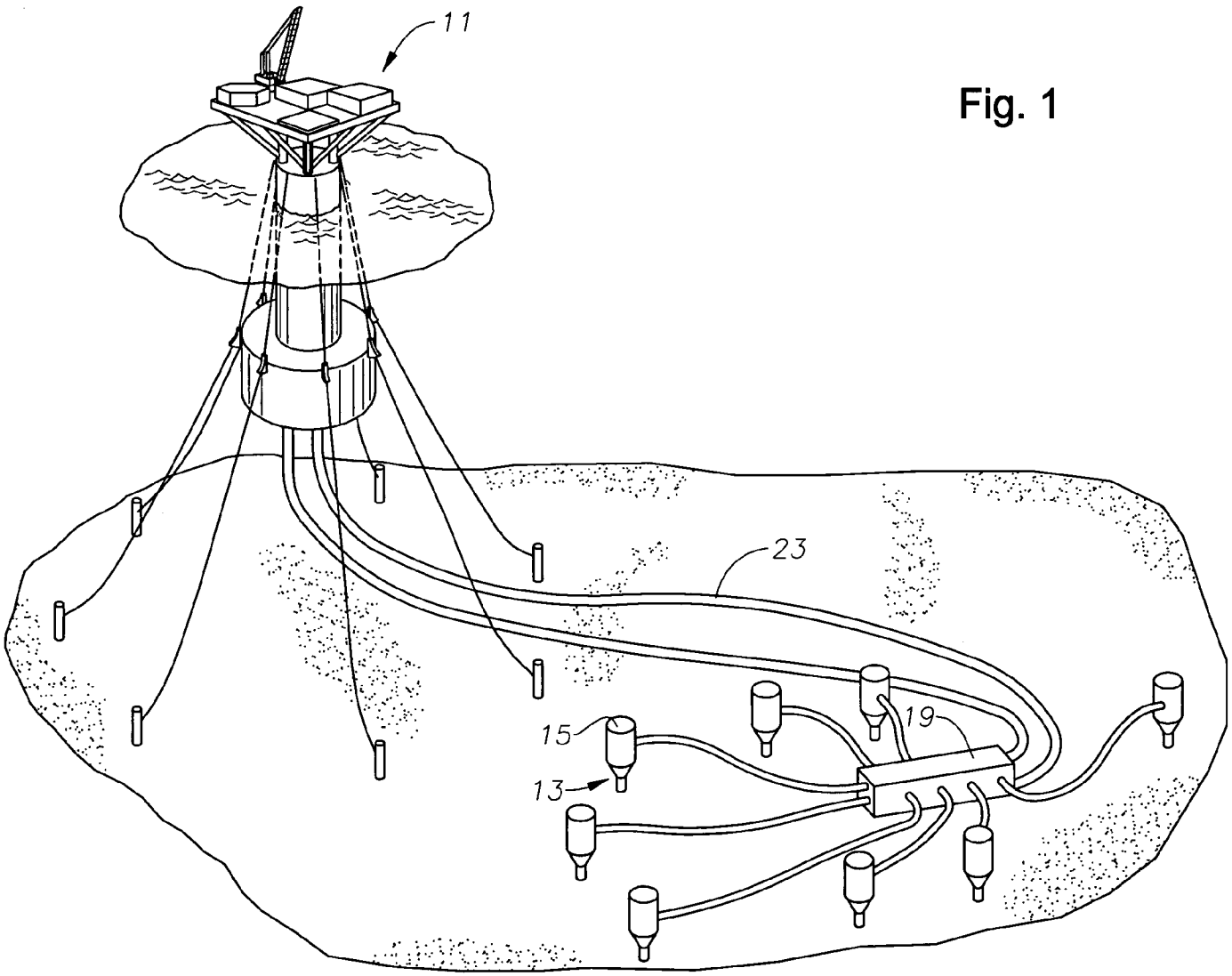
FIG. 1 is a perspective view illustrating a vessel receiving well fluid from a subsea collection manifold that is receiving well fluid from a plurality of subsea wells through a plurality of production lines, constructed in accordance with the present invention.

Referring to FIG. 1, a vessel 11 collects well fluids from subsea wells 13 situated in a cluster on a sea floor 12. Preferably, each subsea well 13 includes a subsea wellhead 15 protruding above the sea floor 12. A production line 17 extends from each wellhead 15 to a collection manifold 19 situated on the subsea floor 12. In the preferred embodiment, the collection manifold 19 includes a plurality of headers 21 (FIG. 2) that selectively receive well fluids from each of the subsea wells 13. A riser 23 extends from the collection manifold 19 to the vessel 11 for transferring well fluids from the subsea floor 12 to the vessel 11. As will be readily appreciated by those skilled in the art, the riser 23 can preferably include a plurality of individual the risers 23 or a bundle of individual tubular structures for supplying segregated streams of well fluid from the collection manifold 19 to the vessel 11.

Figure 2:
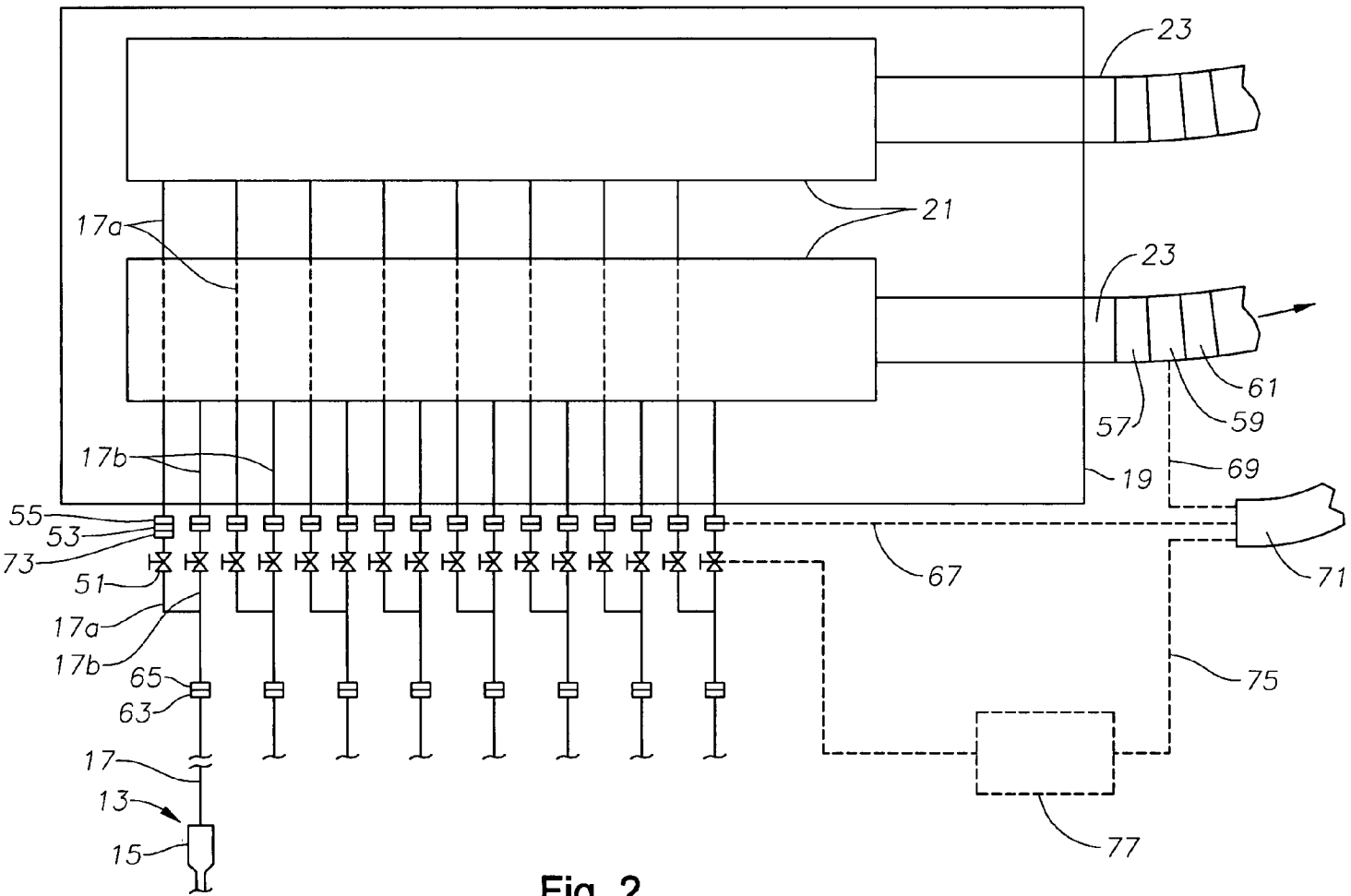
FIG. 2 is a schematic diagram of a collection manifold, production lines, and subsea wells of FIG. 1 according to an embodiment of the present invention.

Referring to FIG. 2, at least one header 21 is located within the collection manifold 19. Preferably, there is a plurality of the headers 21 situated within the outer casing of the collection manifold 19. In the embodiment illustrated in FIG. 2, there are two headers 21 located within the collection manifold 19, however, additional headers 21 can also be located within the collection manifold 19 as desired depending upon operating conditions. In the preferred embodiment, there is a plurality of production lines 17 extending from the plurality of subsea wellheads 15 to the common collection manifold 19.

As shown schematically in FIG. 2, production lines 17 extend from each subsea wellhead 15 to the collection manifold 19. In the embodiment shown in FIG. 2, there are production lines 17 extending from eight subsea wellheads 15 located on the subsea floor 12. A valve 51 is preferably located between the headers 21 within the collection manifold 19 and each subsea wellhead 15. Each valve 51 is preferably a one-way valve that can be actuated either by hydraulic pressure or through manual actuation with an ROV as desired. Valve 51 can be located adjacent the collection manifold 19 either external to the collection manifold 19, or as part of the collection manifold 19 prior to commingling of the well fluid. In the preferred embodiment, production line 17 splits into production lines 17A and 17B before the well fluid reaches valves 51. In the preferred embodiment, there is one valve 51 for each production line 17*a*, 17*b* connecting to collection manifold 19. Preferably, each production line 17 extending from subsea wellhead 15 splits into as many production lines 17A, 17B as there are headers 21 within collection manifold 19. For example, in the embodiment shown in FIG. 2, the production line 17 splits into two additional production lines 17A and 17B, which each then connects to its own respective header 21 within the collection manifold 19. If the collection manifold 19 held three headers 21, the production line 17 will split off into three individual production lines 17A–C connecting to the collection manifold 19. In the embodiment shown in FIG. 2, production line 17A is in fluid communication with one of headers 21 in the collection manifold 19, while production line 17B is in fluid communication with the other header 21 in the collection manifold 19.

A pressure sensor 53 and a temperature sensor 55 are preferably located between valve 51 and each of the headers 21 in the collection manifold 19. The pressure and temperature sensors 53, 55 preferably sense and transmit the pressure and temperature of the well fluid passing through their respective production lines 17A, 17B after the well fluid has flown through the valves 51. Placing pressure and temperature sensors 53, 55 between collection manifold 19 and valve 51 preferably provides an operator with a measured temperature and pressure value of the well fluid immediately before entering collection manifold 19, which accounts for any pressure or temperature drops due to flow through valve 51. Therefore, pressure and temperature sensors 53, 55 sense and transmit inlet pressure and temperature valves to the vessel 11 at the surface of the sea.

Another pair of pressure and temperature sensors 57, 59 are positioned on riser 23 for sensing the temperature and pressure of the well fluids exiting each of the headers 21 of the collection manifold 19. The combination of inlet pressure and temperature sensors 53, 55 and outlet pressure and temperature sensors 57, 59 provide an operator with inlet and outlet conditions of the well fluids entering and exiting collection manifold 19.

Alternatively, pressure sensor 63 and temperature sensor 65 can be placed on the production line 17 before the production line 17 splits into individual production lines 17A, 17B for each of the respective headers 21. Pressure and temperature sensors 63, 65 provide inlet well fluid conditions before the well fluid passes through the valves 51. While this arrangement may have slight pressure and temperature drop-offs as the well fluid passes through the valves 51, fewer pressure and temperature sensors 63 and 65 are required as they are located upstream of the split from production line 17 to separate production lines 17A, 17B.

Sensed temperature and pressure values from inlet sensors 53, 55, or upstream inlet sensors 63, 65, allow calculations of various well fluid properties. For example, in a manner known in the art the operator can calculate the volumetric or mass flow rates of the well fluid passing through the production flow line 17 into the collection manifold 19, the specific heat of the well fluid entering the collection manifold 19, and the density of the well fluid entering the collection manifold 19. One such manner known in the art for calculating inlet conditions such as flow rates, specific heat, and density, is shown in U.S. Pat. No. 4,702,321 issued to Edward E. Horton on Oct. 27, 1987.

In the preferred embodiment and well shown in FIG. 2 with inlet pressure and temperature sensors 53, 55 and outlet pressure and temperature sensors 57, 59, only one set of inlet pressure and inlet temperatures are necessary in order to calculate flow rates, specific heats, and density of the well fluid entering collection manifold 19. As desired, an operator can use the inlet pressure and temperature measured with pressure and temperature sensors 53, 55 or the upstream inlet pressure and temperature measured with inlet pressure sensor 63, and inlet temperature sensor 65.

The measured temperatures and pressures sensed by either inlet pressure and temperature sensors 53, 55 or upstream inlet pressure and temperature sensors 63, 65 are preferably communicated to the surface through an upstream communications line 67. The outlet temperature and pressure values sensed by outlet pressure and temperature sensors 57, 59 are preferably communicated to the surface through a downstream communications line 69. In the preferred embodiment, upstream and downstream communication lines 67, 69 are mechanically coupled in a common bundle for communications between the vessel 11 at the surface and the sensors at the collection manifold 19 on the subsea floor 12.

In addition to having outlet pressure and temperature sensors 57, 59 for an operator to monitor outlet values of the well fluid exiting the collection manifold 19, an operator may optionally also utilize flow rate sensors 73 positioned in the production line 17 upstream of the collection manifold 19. The flow rate sensor 73 can also communicate with the surface through upstream communication line 67. The flow rate sensor 73 option measures volumetric and mass flow rates of the well fluid passing through the production line 17 into the collection manifold 19, and provides a sensed measurement of the flow rates of well fluid passing through the production line 17 for the operator to compare to the calculated flow rates based upon the inlet pressure and temperature sensed by either pressure and temperature sensors 53, 55 or 63, 65. In the preferred embodiment, a communication line 75 preferably extends from the communication bundle 71 so that the communication line 75 can communicate desired control functions from the vessel 11 to the valves 51 adjacent the collection manifold 19.

In the preferred embodiment, a valve actuator 77 is in electrical communication with the communication line 75. The valve actuator 77 preferably receives communications from the vessel 11 at the surface of the sea pertaining to the actuation of the valves 51. The valve actuator 77 can be a remote operated vehicle (ROV), or a series of hydraulically actuated valves that are electronically controlled remotely by the operator so as to provide hydraulic fluid to selectively actuate the valves 51 between opened and closed positions. As will be readily appreciated by those skilled in the art, the valve actuator 77 can be any known method or assembly used to actuate valves remotely at a subsea location.

Figure 3:
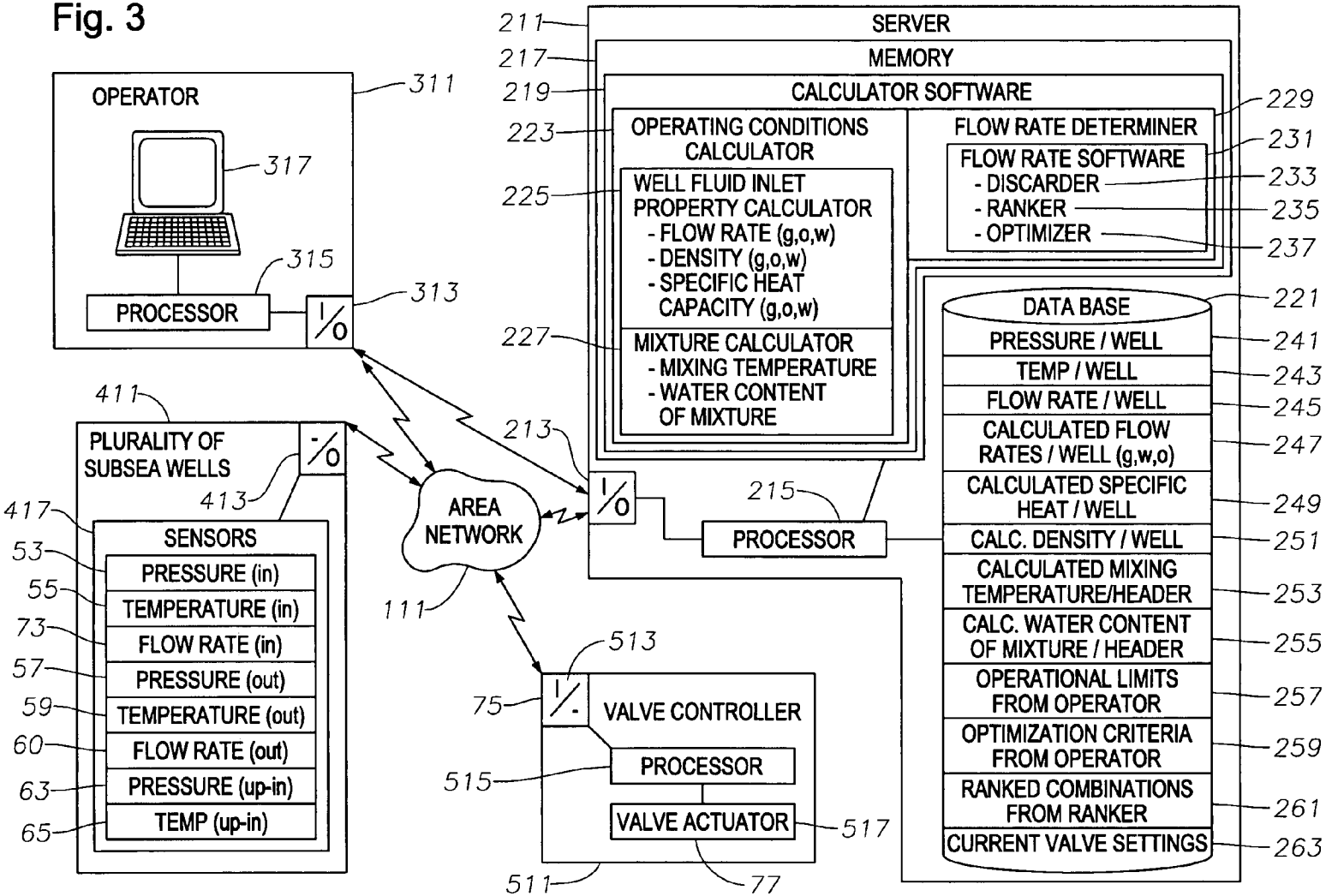
FIG. 3 is a schematic diagram of a system for controlling well fluid production from the subsea wells to the vessel in FIG. 1 according to an embodiment of the present invention.

FIG. 3 illustrates the communication system between the vessel 11 at the surface of the sea and the subsea structures located at the sea floor 12. As illustrated in FIG. 3, an area network 111 provides a communication system between a server 211 in each of the plurality of subsea wells 12 which are grouped together in a single grouping 411, and the valve controller 511. An operator 311 communicates with the server 211 through the area network to receive information from the plurality of subsea wells 411 and control the functions of the valve controller 511. As detailed previously above, a plurality of sensors 417 measure various values of the well fluid at the sea floor 12 to be communicated to the vessel 11 at the surface. Sensor 417 preferably includes pressure sensor 53 located at the inlet of the collection manifold 19 and temperature sensor 55 also located at the inlet of the collection manifold 19. Optionally, sensors 417 can include a flow sensor 73 at the inlet to the collection manifold 19 for communicating the flow rate of the well fluid into the collection manifold 19 from each of the production lines 17A, 17B. Flow sensor 73 is typically a multiphase flow meter. In a manner known in the art, flow monitoring software can be used to provide real-time analysis for estimating the flow rates of the water, oil, and gas in the well fluid.

As discussed previously, an operator may also desire to receive measurements of the temperature and pressure of the well fluid before the well fluid flows through the valves 51 leading into collection manifold 19. In such a situation, the sensors 417 can optionally include upstream pressure and temperature sensors 63, 65. The sensors 417 also include pressure and temperature sensors 57, 59 for the operator to receive measured values of the pressure and temperature of the well fluid exiting the collection manifold 19. In the preferred embodiment, the plurality of subsea wells 411 preferably includes output means 413. The output means 413 includes at least the upstream communications line 67 for communicating pressure and temperature values from either inlet pressure and temperature sensors 53, 55 or pressure and temperature sensors 63, 65 located upstream of valve 51. Output means 413 can also include the downstream communications line 69 for communicating pressure and temperature values of the well fluid exiting the collection manifold 19 from the pressure and temperature sensors 57, 59. Through area network 111, measured values of well fluid entering and exiting the collection manifold 19 from the plurality of wells 411 can be communicated to the vessel 11 located at the surface where the operator 311 and the server 211 can utilize these measurements.

The valve controller 511 advantageously provides means for actuating the valves 51 leading into the collection manifold 19. The valve controller preferably includes input means 513 for receiving signals from the vessel 11 at the surface of the sea through area network 111. Input means 513 can include the communications line 75 previously described in FIG. 2. The valve controller 511 also includes a processor 515 for receiving control signals from area network 111 through communications line 75 of input means 513. The processor 515 advantageously receives signals and controls a valve actuator 517, which physically actuates each of the valves 51 controlling the well fluid flow into the collection manifold 19 and each of the respective headers 21. The valve actuator 517 preferably comprises the valve actuator 77 previously discussed in FIG. 2. As discussed with respect to FIG. 2, the valve actuator 77 can comprise an ROV remote operated vehicle, or a series of hydraulic controls for sending hydraulic fluid to each of the individual valves for actuation. The operator 311 preferably sends control commands to the server 211, which then communicates those control commands through area network 111 to valve controller 511.

The operator 311 preferably includes input/output means 313 that communicates with the server 211 in a manner known in the art. The operator 311 preferably also includes a processor 315 for receiving and communicating data between display means 317 and server 211. Display means 317 can be a keyboard and monitor, a PDA, a touch-screen monitor or any other known method or assembly manner for interfacing with a computer system. The processor 315 is preferably a central processing unit of a computer. As will be readily appreciated by those skilled in the art, the operator 311 can be located on the vessel 11 at the surface of the sea, or at a remote location that is in communication with the server 211 located on the vessel 11 at the surface of the sea.

The server 211 preferably includes input/output means 213 for communication with the area network 111 and the operator 311. The server 211 includes a processor 215 which can be any known central processing unit as used by those skilled in the art for server technologies today.

The server 211 also includes server memory 217. The memory 217 preferably includes calculator software 219 programmed within memory 217. Calculator software 219 calculates the well fluid properties, like specific heat, density and flow rates of the well fluid passing through production lines 17, from the measured values transmitted from sensors 417 at the plurality of wells 411. Calculator software 219 also calculates mixing temperatures and water content of the well fluid within each of the respective headers 21 of collection manifold 19. Calculator software 219 advantageously determines the proper flow rate through production lines 17A, 17B into each of respective headers 21 of collection manifold 19 for desired properties of the well fluid exiting collection manifold 19. Server 211 also includes a database 221 for storing measured and calculated values of the well fluids entering and exiting collection manifold 19. Database 221 also advantageously provides storage space for input data from an operator for desired operating conditions.

Calculator software 219 preferably includes operating conditions calculator 223. Operating conditions calculator 223 preferably includes well fluid inlet property calculator 225. Well fluid property calculator 225 is a submodule of calculator software 219 for calculating flow rates of the gases, oil, and water passing through production line 17 into collection manifold 19 at the sea floor 12. Well fluid inlet property calculator 225 can alternatively utilize flow rate sensors 73, instead of one of the measured values from the inlet pressure and temperature sensors 53, 55 or upstream inlet pressure and temperature sensors 63, 65. Well fluid property calculator 225 also advantageously calculates the density of the gas, oil, and water within the well fluids passing through lines 17A, 17B. Well fluid property calculator 225 advantageously also calculates the specific heat capacity of the gases, oils, and waters within the well fluid passing through production lines 17A, 17B. Well fluid property calculator 225 preferably utilizes the manners as previously taught in the art in U.S. Pat. No. 4,702,321 for calculating the flow rates, density, and specific heat capacities of the oils, gases, and waters passing through production lines 17 into collection manifold 19. Operating conditions software 223 of calculator software 219 also preferably includes mixture calculator 227 for calculating the temperature of the well fluids combining within the collection manifold 19. In the situation of multiple headers 21 within the collection manifold 19, mixture calculator 227 advantageously calculates mixing temperatures within each of the specific headers 21 of the collection manifold 19. Mixture calculator 227 also calculates the water content of the well fluid mixtures either within the collection manifold 19 or within each respective header 21. Mixture calculator 227 can use a number of calculating formulae for determining the mixing temperature and water content of the mixture of well fluids within the collection manifold 19. For example, for calculating mixing temperatures of the well fluids mixing within each header 21 or simply within the collection manifold 19, mixture calculator 227 can utilize the following formula:

$$T_{mix} = \frac{\sum_{i=1}^{n} (\rho_w C_{pw} Q_{wi} + \rho_o C_{po} Q_{oi} + \rho_g C_{pg} Q_{gi}) \cdot T_i}{\sum_{i=1}^{n} (\rho_w C_{pw} Q_{wi} + \rho_o C_{po} Q_{oi} + \rho_g C_{pg} Q_{gi})}$$

$\rho$ = Density $C_p$ = *SpecificHeatCapacity*

$Q$ = *VolumetricFlowRate*

$w, o, g$ = water, oil, gas

Likewise, for calculating the water content of the mixture of well fluids within the collection manifold 19 and the header 21 of collection manifold 19, mixture calculator 227 can utilize the following formula:

$$WC_{mix} = \frac{\sum_{i=1}^{n} Q_{wi}}{\sum_{i=1}^{n} (Q_{wi} + Q_{oi})}$$

For each of these formulas the temperature and pressure of the inlet conditions are provided from the sensors 417, while the values for the flow rates, density, and specific heat capacity of the oil, gas, and water of the well fluid entering the collection manifold 19 from each of the plurality of the subsea wells 13 is provided from calculated values supplied by well fluid property calculator 225.

Database 221 preferably includes sensed pressure value storage 241 for sensed pressure values transmitted from sensors 53 or 63 at the plurality of subsea wells 411 through area network 111. Database 221 also includes sensed temperature value storage 243 for sensed temperature values transmitted by either temperature sensors 55 or 65. Database 221 also preferably includes calculated flow rates storage 247 as provided from well fluid property calculator 225 and transmitted into database 221 through server processor 215. Database 221 also preferably includes calculated specific heat storage 249 which also receives values from well fluid property calculator 225 within memory 217. Database 221 also preferably includes calculated density storage 251 as provided by well fluid property calculator 225 within memory 217, and communicated via server processor 215. Mixture calculator 227 advantageously receives values for the inlet pressure, inlet temperature, calculated flow rates, calculated specific heats, and calculated densities of the well fluids entering each respective header 21 of the collection manifold 19 from storage 241, 243, 247, 249, and 251 within database 221. After mixture calculator 227 calculates the mixing temperatures and water content of mixture of well fluid within the headers 21 of the collection manifold 19, the calculated mixing temperature value as calculated by mixer software 227 is transmitted through processor 215 into database 221 within calculated mixing temperature per header storage 253. The value for water content of mixture as calculated by mixture calculator 227 is also transmitted through server processor 215 to database 221 within calculated water content of mixture per header storage 255.

Calculator software 219 also preferably includes a flow rate determiner 229. Flow rate determiner 229 advantageously provides flow rate software 231 for optimizing and controlling the properties of the well fluids exiting the collection manifold 19 from each of the headers 21. Flow rate control software 231 helps control the amount of well fluids entering the headers 21 of the collection manifold 19 from each of the production lines 17A, 17B from each of the respective subsea wells 13. Flow rate software 231 preferably includes a discarder 233, a ranker 235, and an optimizer 237 which calculates the most optimized inlet conditions of the well fluids into the respective headers 21 of the collection manifold 19 for desired flow rates of well fluid from collection manifold 19.

The values for flow rate software 231 come from the calculated flow rates of the gas, water, and oil stored within database storage 247, the calculated specific heats of the gas, oil, and water stored at database storage 249, and the calculated density of gas, oil, and water of the well fluids in database storage 251. Flow rate software 231 also receives the calculated mixing temperatures and calculated water content of the mixtures from database 221 storage modules 253 and 255 as calculated by mixture calculator 227. Database 221 also provides values to flow rate software 231 which are inputted from operator 311, communicated to server 211, and stored in database 221 within an operational limits storage 257, for the desired operational limits of the well fluid exiting collection manifold 19. Operational limits can include the water content, flow rate, pressure, and temperature as inputted and desired from the operator for proper flow of the well fluids through the riser up to the vessel 11 at the surface of the sea. Operational limits stored in database storage 257 provide outer boundaries by which flow rate determiner 229 and flow rate software 231 discard subsea well 13 and header 21 combinations that are unacceptable.

Flow rate software 231 also preferably includes a ranker 235 which compares calculated mixing temperature and water content conditions of the well fluid exiting each of the respective headers 21 of the collection manifold 19 against inputted values stored in optimization criteria module 259 of database 221, as entered by operator 311. The ranker 235 advantageously compares and ranks various subsea well 13 and header 21 combinations based on mixing temperatures and water content values as calculated by mixture calculator 227. Various subsets of open and closed control valves 51 define the various combinations or arrangements being ranked by the ranker 235. The rankings created by the ranker 235 are for the operator 311 to observe, or for an optimizer 237 (discussed below) to evaluate various combinations of subsea well inlets. Ranked combinations of well inlets calculated by ranker 235 are preferably stored within database 221 at ranked combination from ranker storage 261. Ranked combinations from ranked combination from ranker storage 261 can be transmitted via input/output means 213 to operator 311 for display on interface means 317.

Flow rate software 231 also advantageously includes an optimizer 237 for automatically determining whether any of the ranked subsea well 13 and header 21 combinations are more efficient compared to current operating conditions at the plurality of subsea wells 411. Current valve settings at the plurality of subsea wells 411 are advantageously conveyed to database 221 and stored in the current valve settings storage 263 for retrieval by the optimizer 237. If the current valve settings are not the most efficient or closest to the optimized criteria from the operator 311 in storage 259, optimizer 237 communicates necessary valve 51 setting changes to the operator 311. The operator 311 can utilize the suggested changes for communication with the valve controller 511 for valve actuator 517 to actuate valve 51 until the desired well fluid flows are entering headers 21 of collection manifold as prescribed by optimizer 237.

In operation, well fluids flow from each of the subsea wells 13 through the production line 17 toward the collection manifold 19. Optionally, pressure and temperature sensors 63, 65 located upstream of the inlet to collection manifold 19 sense the temperature and pressure of each of the well fluid feeds flowing through each production line 17 extending from each of the subsea wells 13. Sensed values from the temperature and pressure sensors 63, 65 are transmitted through the upstream communications line 67 to the vessel 11 at the surface of the sea. Before reaching the collection manifold 19 and valves 51, each production line 17 extending from each individual subsea well 13 divides into an equal number of individual production lines 17A, 17B as the number of headers 21 located within the collection manifold 19. The well fluid from each of the subsea wells 13 flows through each of the individual collection lines 17A, 17B to the valves 51 located between the subsea wells 13 and the collection manifold 19. The valves 51 regulate flow through each of the individual production lines 17A, 17B into each of the individual headers 21 of the collection manifold. After the well fluid flows through the valves 51, inlet pressure and temperature sensors 53, 55 sense the inlet temperature and pressure of the well fluid entering the collection manifold 19. The sensed pressure and temperature values from pressure and temperature sensors 53, 55 are transmitted through upstream communications line 67 and the area network 111 to the vessel 11 at the surface of the sea.

The inlet pressure and temperature values sensed by either the inlet pressure and temperature sensors 53, 55, or the upstream inlet pressure and temperature sensors 63, 65 are collected and stored in the database 221 of the server 211 after being communicated through the area network 111. The operator 311 uses the user interface 317 and the processor 315 to communicate operational parameters for well fluid flowing out of the collection manifold 19 into the riser 23. The operational parameters entered by the operator 311 are communicated through input/output means 313 electronically to the server 211 and stored within the database 221 for later use by the memory 217. The processor 215 of the server 21 f utilizes calculator software 219 found on the memory 217 to calculate various well fluid characteristics based upon the inlet temperature and pressures sensed by the pressure and temperature sensors 53, 55 or 63, 65.

As detailed before, such well fluid properties include the density, the specific heat capacity, and the flow rates of the gas, oil, and water found within the well fluid entering the collection manifold 19. Alternatively, when the flow meters 73 are utilized, the well fluid properties include the density, the specific heat capacity, and either the temperature or the pressure of the well fluid (whichever is being replaced in calculations by the flow rates from flow meters 73). Furthermore, when flow meters 73 are utilized, in addition to inlet pressure and temperature sensors 53, 55 or upstream inlet pressure and temperature sensors 63, 65, the well fluid properties only include the density, the specific heat capacity of the well fluid entering the collection manifold 19, as the temperature, pressure, and flow rates are sensed values. For the ease description, a flow rate value from a flow rate sensor 73 is interchangeable within the processes of calculator software 219 with either or both inlet temperature and pressures sensed by the pressure and temperature sensors 53, 55 or 63, 65.

The calculated values for the density, specific heat, and flow rates of the water, oil, and gas of the well fluids are communicated through the processor 215 and stored within the database 221 of the server 211. Mixture calculator 227 located on the memory 217 is utilized by the processor 215 to calculate the temperature of mixing well fluids within each of the specific headers 21 of the collection manifold 19, and the water content of the mixtures within each of the specific headers 21. The mixing temperature and water content of the mixing well fluids within the headers 21 of collection manifold 19 are communicated from the processor 215 to the database 221 of the server 211.

In operation, several calculations are made for various combinations of well fluid production streams flowing into the specific headers 21 of the production manifold 19 of mixing temperature and water content of mixtures and stored within the database 221. The flow rate determiner 229 utilizes flow rate software 231 to discard certain well fluid inlets for optimum calculating capabilities of the processor 215. The flow rate determiner 229 uses the ranker 235 to arrange various combinations in an order for understanding which subsea well 13 and header 21 combination is most in line with the operational parameters as set forth by the operator 311. The flow rate determiner 229 also utilizes the optimizer 237 for suggesting which combination is most in line with the operational parameters provided by the operator 311, and for adjusting the inlet settings at the valves 51 leading into the collection manifold 19. The process utilized by the flow rate determiner 229 is detailed further in FIG. 4 and will be discussed below.

Should the operator 311 select to change the current valve settings from current operational settings to suggested settings of the valves 51 from the optimizer 237, the server 211 sends a command through the area network 111 to the valve controller 511 for actuation of the various valves 51 that correspond with the suggested subsea well 13 combination from the optimizer 237. The actuation commands communicated through the area network 111 to the valve controller 511 are received through input means 513 and processed by the processor 515. The processor 515 communicates the actuation commands to the valve actuator 517 for actuating the valves 51 into the valve 51 settings of subsea well 13 and header 21 combination.

The process for determining and selecting the optimized combination of well fluid inlets from the subsea wells 13 to headers 21 of the collection manifold 19 is illustrated in FIG. 4. As discussed above, the numerous combinations of well fluid inlets and headers create large numbers of possible combinations of well fluid inlets and headers 21 or outlets for the well fluid to pass through the collection manifold 19. Because of the strain that such calculations could have on the processor 215 of the server 211 in some operating systems, the number of inlet production lines 17 from various subsea production wells 13 can be reduced at the initial stages to accommodate the calculating capacity of the processor 215. Therefore, the first step of the process must be to select the subsea wells for calculations. The operator can manually select the subsea wells 13 for initial calculations, or the server 211 can select a first set of initial wells 13 to calculate combinations with the headers 21 of the collection manifold 19 for initial calculations of the process. Preferably, the number of subsea wells 13, selected in conjunction with the number of headers 21 utilized by the collection manifold 19, will be within the operating capacity of the operator's processor 215.

Upon selection of the subsea wells 13, the well fluid property calculator 225 calculates the flow rate, the density, and the specific heat capacity of the oil, gas, and water found in the well fluids entering the headers 21 of the collection manifold 19 from each of the production lines 17A, 17B extending from each of the subsea wells 13. As discussed above, the well fluid property calculator 225 calculates these values based upon the sensed pressure and temperatures transmitted from the pressure and temperature sensors 53, 55 or 63, 65 located upstream of the collection manifold 19. Calculated values of the flow rate, density, and specific heat capacity of the oil, gas, and water in the well fluid are communicated to the database 221 for storage modules 241, 243, and 247. In the event the operator 311 chooses to utilize flow sensors 61, the operator 311 can compare the calculated flow rates stored in 247 with the sensed flow rates stored in sensed flow rate storage 245 in the database 221 for accuracy purposes.

The mixture calculator 227 then retrieves the calculated values of the flow rate, density, and specific gravity of the oil, gas, and water in the well fluids entering the collection manifold 19, as well as the sensed pressure and temperature values from the sensors 53, 55 or 63, 65 located adjacent the collection manifold 19. The mixture calculator 227 then calculates the mixing temperature and the water content of the mixture of well fluids entering each individual header 21 of the collection manifold 19 based upon various combinations of headers 21 and production lines 17A, 17B from the subsea wells 13. The mixing software calculates the mixing temperature and water content for each header 21 through each combination of the production lines 17A, 17B from the selected subsea wells 13 feeding into each of the headers 21. As discussed above, in the situation of four subsea wells 13 feeding into a collection manifold 19 with two headers 21, there are 256 possible combinations of subsea well 13 and header 21 combinations. The calculated temperature and mixing water content for each of the headers 21 is communicated and stored in the database 221 within the mixing temperature per header storage 253 and the water content per header storage 255. The flow rate determiner 229 retrieves the mixing temperature and mixed water content calculations for use by the flow rate software 231.

The discarder 233 of the flow rate software 231 found within the flow rate determiner 229 compares operational limits from the database 221 to the calculated temperature and water contents from the mixture calculator 227. The operational limits located in the database 221 were previously entered by the operator 311 and stored within operational limits storage 257. The discarder 233 then removes combinations of subsea wells 13 feeding into the headers 21 having mixing temperature or water content values outside of the operational limits as determined by the operator 311. In the preferred embodiment, the removed subsea well 13 and header 21 combinations are no longer part of the process performed by the flow rate determiner 229 once the discarder 233 has removed the values outside of the operational parameters as determined by the operator 311.

Within the flow rate software 231, the ranker 235 then receives the mixing temperature and water content values of well fluid mixtures within the headers 21 for each of the subsea well 13 and header 21 combinations that were within the operational limits set by the operator 311. The ranker 235 compares the individual subsea well 13 and header 21 combinations and ranks them in an order corresponding to optimization criteria inputted by the operator 31 and stored within optimization criteria 259 at the database 221. As will be readily appreciated by those skilled in the art, the desired operating exit conditions criteria can vary for specific operational needs. For example, in systems producing well fluids in colder waters, it may be desirous for the outlet mixing temperature of the well fluids exiting the collection manifold 19 to be higher to prevent the formation of hydrates within the riser 23 extending up to the vessel 11. Alternatively, in shallow waters the temperature of the well fluids exiting the collection manifold may not be as large of a factor due to the short distance that the well fluids have to travel through the riser 23 to the vessel 11.

The optimizer 237 receives the remaining subsea well 13 and header 21 combinations from the ranker 235 and communicates the ranked combinations to the operator 311 for viewing. The optimizer 237 also communicates to the operator 311 whether the current settings of valves 51 are not the same as the highest ranked subsea well 13 and header 21 combination valve settings. At this step, the optimizer 237 accounts for whether the subsea wells 13 were initially not selected for computational purposes at the beginning of the program. The optimizer 237 asks whether there are additional subsea wells 13 that were discarded and not yet used for calculation purposes. If there are subsea wells 13 that were not used for computational purposes to this point, the process proceeds along the yes arrow and the optimizer 237 sets the highest ranked subsea well 13 and header 21 combination from the ranker 235 as an equivalent subsea well 13 and header 21 input. The equivalent subsea well 13 and header 21 input is placed as a required fixed value in the operational limits storage 257 found within the database 221. In this manner, the highest ranked subsea well 13 and header 21 combination from the initial calculations provide a subsea well 13 and header 21 combination equivalent that is not altered due to further calculations with subsea wells 13 that were not previously calculated entering into the headers 21 of the collection manifold 19.

After setting the equivalent subsea well 13 and header 21 combination as a set value for calculational purposes with additional subsea wells 13, the calculator software 219 then returns to the subsea well 13 selector step for calculating various mixing temperature and water content of subsea well 13 and header 21 combinations with the equivalent subsea well 13 and header 21 combination and the additional subsea wells 13 that have not yet been selected. The process discussed above is repeated until all subsea wells 13 feeding into the collection manifold 19 are used for calculational purposes and ranked by the ranker 235 before entering the optimizer 237.

When all subsea wells 13 have been considered, and there are no additional subsea wells 13 that were not yet used for calculational purposes, then the process follows the "no" arrow that leads to a decisional step of the process. The decisional step is whether to change the subsea well 13 and header 21 combination to the highest ranked combination from the ranker 235. If the answer is "yes," then the server 211 communicates the changes to the settings of the valves 51 that are needed through the area network 111 to the valve controller 511 for actuation of the valves 51 by the valve actuator 517. After transmitting the command, the process then continues to another decisional box as to whether to run a continuous loop on the calculator software 219. If the answer was "no" to the decisional box of whether to change the subsea well 13 and header 21 combinations to the highest ranked combination, then it immediately proceeds to the decisional box of whether to run a continuous loop of the calculation software 219. If the answer is "no" then the processor 215 waits for a signal from the operator 311 whether to proceed with a continuous loop or not. If a signal is received then it will proceed back to the selection of initial subsea wells 13 for calculational purposes at the beginning of the process. If the signal is not received then it will continue to wait for a signal until such signal is received. If the answer to run continuous loop is "yes" then it will immediately proceed back to the beginning of the calculator software 219 process. A continuous loop can advantageously comprise repeating the process immediately upon completion of the prior process, or waiting a preselected amount of time before repeating the process.

The system and method described above allows real-time analysis of commingling flows of well fluids entering and exiting the collection manifold 19. The real-time analysis is possible based upon merely the inlet pressure and temperatures of the well fluids entering the collection manifold 19. Additionally, with inlet flow meters and corresponding software, real-time information about inflow conditions becomes available. This includes total mass flow rate, gas fraction, water cut, pressure and temperature in each inflow. A computer program can then calculate mixing temperature and water cut in each outflow for all possible well combinations. The system provides the operator with a continuously updated list ranking the different subsea well and header combinations based on criteria defined by the operator. If the program detects that the current subsea well and header combination gives mixing temperatures and/or water cuts outside acceptable limits, the operator can be warned and recommended to switch to another combination.

With this system, the risk of encountering flow assurance problems is reduced. For an existing field with a given design, this can reduce the OPEX. For a new field, CAPEX can be reduced if the reduced risk of flow assurance problems is incorporated into the design. The system can be used both subsea and topsides.

Figure 5:
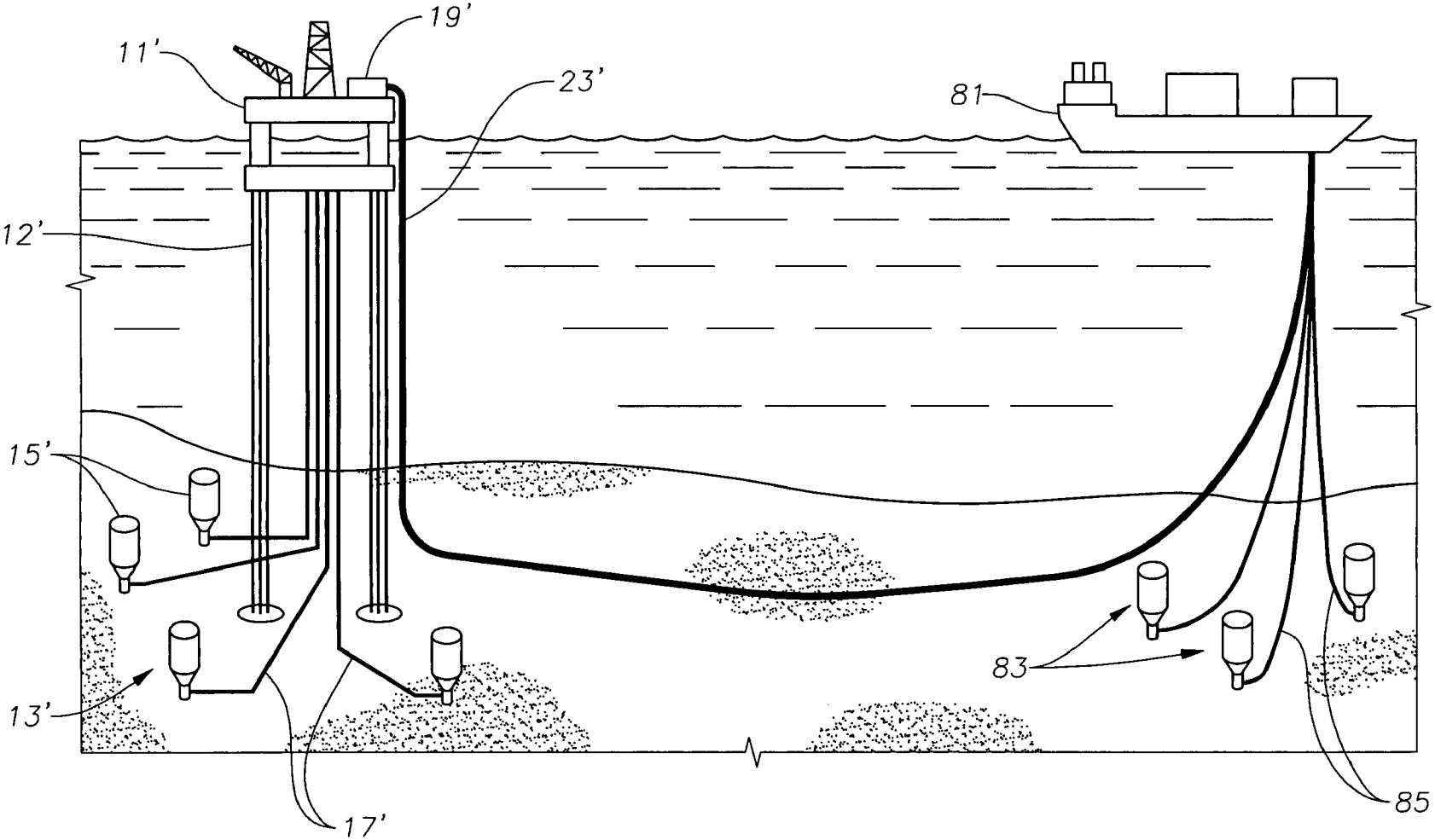
FIG. 5 is an environmental view illustrating an alternative embodiment having a vessel receiving well fluid from a plurality of subsea wells which are commingled in a collection manifold on the vessel and then conveyed to another floating vessel, constructed in accordance with the present invention.

Referring to FIG. 5, an alternative embodiment is shown for using the system topside. A vessel 11' floats on the surface of the sea, above a cluster or plurality of subsea wells 13'. While vessel 11' is shown as a tension leg platform (TLP), this is merely for illustrative purposes. Vessel 11' can be any number of vessels known and available to those skilled in the art, such as a mini-tension leg platform (Mini-TLP), a fixed platform (FP), a compliant tower (CT), a spar platform (SP), or a marine buoy such as that shown in FIG. 1. A wellhead 15' is shown positioned on each of the subsea wells 13. A production line 17' extends from each of the wellheads 15' to the vessel 11' at the surface of the sea. Well fluid flows through each of the individual production lines 17 to the vessel 11' unlike the embodiment shown in FIG. 1.

At the vessel, the production lines 17' are in fluid communication with a collection manifold 19'. The well fluid from each of the individual production lines 17' commingles within collection manifold 19'. Collection manifold 19' is substantially the same as the collection manifold 19 of FIGS. 1 and 2, except for its location being topside. Sensors (not shown) are preferably located along production lines 17' in a manner substantially similar to the pressure, temperature, and flow rate (flow meter) sensors discussed above. Each of the sensors also communicate with the server to calculate the mixing temperature and water content of the well fluid mixing in the collection manifold 19'.

A conduit 23' connects to collection manifold 19' for conveying well fluid from the collection manifold 19'. The conduit 23' can convey the well fluid through one passage when the collection manifold acts as a single header, or through a plurality of passages bundled together when the collection manifold comprises a plurality of segmented headers discharging into conduit 23'. The conduit 23' conveys the well fluid from the vessel 11' to a floating production storage and offloading vessel (FPSO) 81. Typically, the FSPO 81 is a large distance away from the vessel 11 ' such that it is not advantageous to have the well fluid from each of the subsea wells 13' flow directly to the FSPO 81. Conveying the well fluid from each of the plurality of subsea wells 13' allows an operator to pump the well fluid, as needed, in order to convey the well fluid to the FSPO 81. Typically, the FPSO 81 will also be receiving well fluid from another cluster or plurality of subsea wells 83 through a plurality of production lines or risers 85.

Figure 4A:
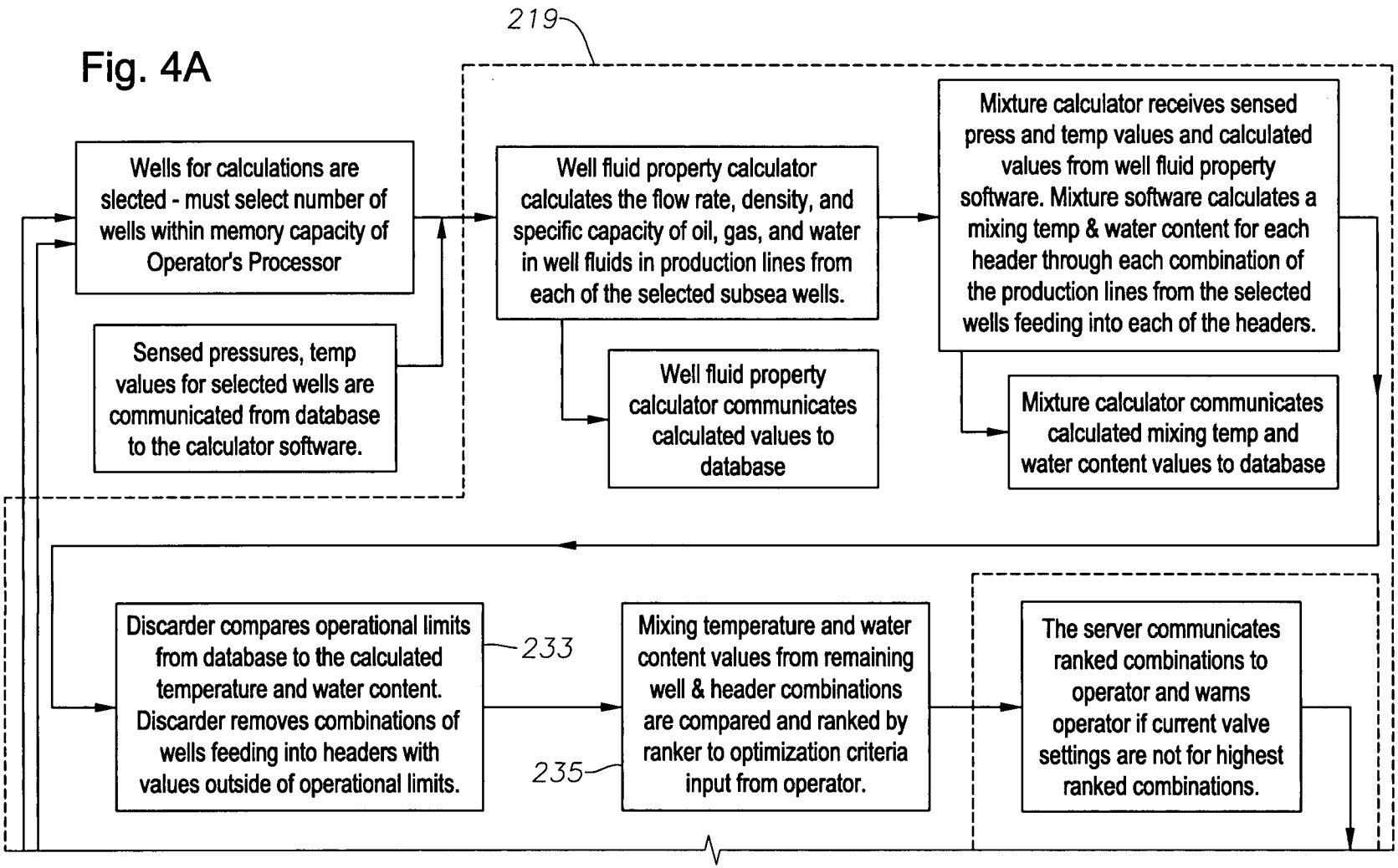
FIGS. 4A and 4B are a schematic flow diagram of software for controlling the well fluid production from the subsea wells to the vessel shown in FIG. 1 according to an embodiment of the present invention.
Figure 4B:
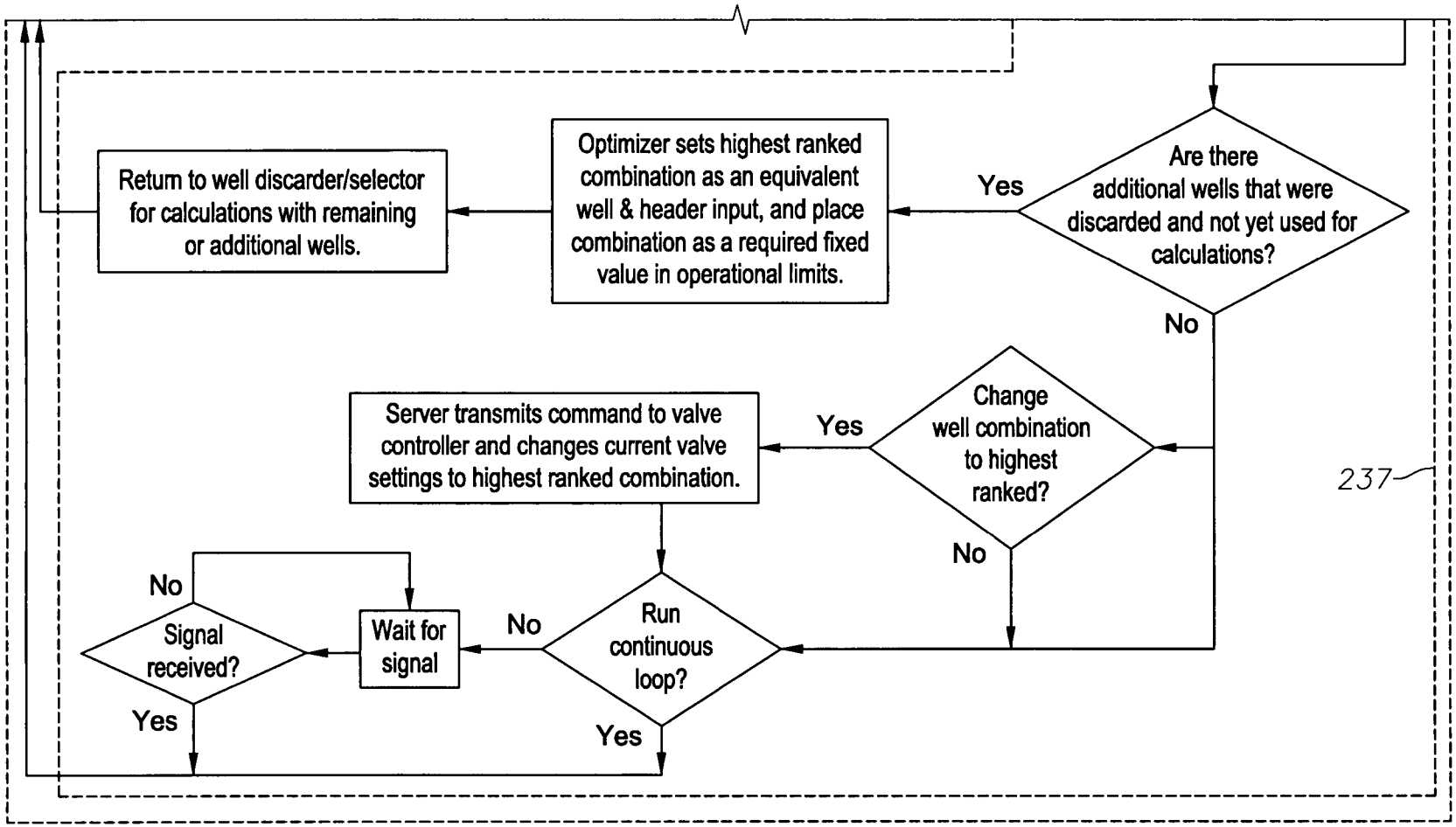

The alternative embodiment illustrated in FIG. 5 advantageously allows collection, treatment, and storage of well fluid from a plurality of spaced-apart clusters at a single FSPO 81. Having the well fluid from the plurality of subsea wells 13' stored at the FSPO 81 allows a smaller transport tanker (not shown) to only have to collect well fluid from one vessel located above one of the cluster or plurality of subsea wells rather than going to both clusters. Due to the distance that the well fluid may travel within the conduit 23', the process described with respect to FIGS. 3, 4A and 4B is utilized in order to attempt to achieve a desired temperature and water content of the well fluid exiting the collection manifold 19' into the conduit 23'. Maintaining the temperature and water content of the well fluid within a range of the desired temperature and water content helps prevent the formation of hydrates and waxes within the conduit 23'.

The invention claimed is:

1. A system for managing production from a plurality of subsea wells, the system comprising:

a collection manifold having a plurality of headers, each header adapted to collect well fluid from a fluid output of each of the plurality of subsea wells and convey the well fluid to a vessel positioned at a surface of a sea;

a plurality of flow control valves positioned between each of the plurality of subsea wells and the collection manifold to control the flow of well fluid entering each of the plurality of headers;

at least one sensor positioned adjacent a well fluid inlet of the collection manifold for sensing a plurality of properties of the well fluid entering the collection manifold;

a computer in communication with the at least one sensor, the computer having a memory and defining a server, calculator software stored in the memory in communication with the at least one sensor to calculate well fluid properties of the well fluid entering the collection manifold from each of the plurality of subsea wells and well fluid properties of the well fluid conveyed from the collection manifold to the vessel positioned at the surface of the sea to thereby selectively open or to selectively close a subset of the plurality of flow control valves defining a desired arrangement of the plurality of flow control valves to control the well fluid flow into each header responsive to predetermined criteria, the calculator software comprising:

a well fluid inlet property calculator responsive to the sensed plurality of properties to calculate a specific heat capacity, and a density for a selected fluid of the well fluid from each of the plurality of subsea wells, a mixture calculator responsive to the well fluid inlet property calculator to calculate a mixing temperature and a water content of a mixture of the well fluid, the mixture being defined by the mixing of well fluid from each of the plurality of subsea wells in each of the plurality of headers, and a flow rate determiner responsive to the mixing temperature and the water content from the mixture calculator and a desired temperature and a desired water content of the mixture of well fluid exiting the collection manifold to determine a selected flow rate of well fluid entering each of the plurality of headers from each of the plurality of subsea wells to thereby attempt to achieve the desired temperature and desired water content, the flow rate determiner determining a plurality of well fluid inlet flow rates entering each of the plurality of headers to define a desired arrangement of the flow control valves; and a controller responsive to the calculator software that is adapted to control each of the plurality of flow control valves.

2. A system according to claim 1, wherein:

the at least one sensor comprises a temperature sensor positioned adjacent the collection manifold to sense a well fluid inlet temperature value, and a flow rate meter positioned adjacent the collection manifold to sense a well fluid inlet flow rate value; and the sensed plurality of properties are the sensed well fluid inlet temperature value and the sensed well fluid inlet flow rate value, the well fluid inlet property calculator being responsive to the sensed well fluid inlet temperature and flow rate values to calculate a well fluid inlet pressure.

3. A system according to claim 1, wherein:

the at least one sensor comprises a pressure sensor positioned adjacent the collection manifold to sense a well fluid inlet pressure value, and a flow rate meter positioned adjacent the collection manifold to sense a well fluid inlet flow rate value; and the sensed plurality of properties are the sensed well fluid inlet pressure value and the sensed well fluid inlet flow rate value, the well fluid inlet property calculator being responsive to the sensed well fluid inlet pressure and flow rate values to calculate a well fluid inlet temperature.

4. A system according to claim 1, wherein:

the at least one sensor comprises a pressure sensor positioned adjacent the collection manifold to sense a well fluid inlet pressure value, and a temperature sensor positioned adjacent the collection manifold to sense a well fluid inlet temperature value; and the sensed plurality of properties are the sensed well fluid inlet pressure value and the sensed well fluid inlet temperature value, the well fluid inlet property calculator being responsive to the sensed well fluid inlet pressure and temperature values to calculate a well fluid inlet flow rate.

5. A system according to claim 4, wherein the well fluid inlet property calculator further calculates a volumetric flow rate responsive to the sensed temperature value and the sensed pressure value.

6. A system according to claim 1, wherein the controller comprises a remote operated vehicle.

7. A system according to claim 1, wherein the controller comprises a valve actuation assembly that is remotely controlled from the surface.

8. A system according to claim 1, wherein the sensor is positioned between the plurality of flow control valves and the collection manifold.

9. A system according to claim 1, wherein the flow rate determiner further comprises a discarder responsive to the mixing temperature and the water content from the mixture calculator and a plurality of preselected operational limits including a temperature and a water content of the mixture of well fluid exiting the collection manifold, to discard each subset of the plurality of flow control valves with mixing temperatures and water content values from the mixture calculator that are outside of the preselected operational limits.

10. A system according to claim 1, wherein the flow rate determiner further comprises a ranker responsive to the mixing temperature and the water content from the mixture calculator and the desired temperature and the desired water content of the mixture of well fluid exiting the collection manifold to rank each subset of the plurality of flow control valves based upon the proximity of the mixing temperature and the water content for each subset of the plurality of flow control valves in relation to the desired temperature and the desired water content of the mixture of well fluid exiting the collection manifold.

11. A system according to claim 1, further comprising a database in communication with the calculator software and the at least one sensor, for the storage of sensed and calculated values from the calculator software and the at least one sensor.

12. A system according to claim 11, wherein the database provides values stored from the well fluid property calculator to the mixture calculator and to the flow rate determiner.

13. A system according to claim 11, wherein the database provides values stored from the well fluid property calculator and the mixture calculator to the to the flow rate determiner.

14. A system according to claim 11, wherein the database stores the desired mixing temperature and the desired water content of the well fluid exiting the collection manifold for providing to the flow rate determiner.

15. A system according to claim 1, further comprising an outlet temperature sensor positioned adjacent the outlet of the collection manifold and in communication with the computer, to sense an outlet temperature value of the well fluid exiting the collection manifold.

16. A system for managing production from a collection manifold receiving well fluid from a plurality of subsea wells, comprising:

at least one sensor adapted to be positioned adjacent a well fluid inlet of the collection manifold for sensing a plurality of properties of the well fluid entering the collection manifold;

a calculator software responsive to one or more values communicated to the calculator software from the at least one sensor, the values being selected from the group consisting of a well fluid inlet pressure value, a well fluid inlet temperature value, and a well fluid flow rate value, and responsive to a desired temperature and a desired water content for the mixture of well fluid exiting the collection manifold, to determine a selected flow rate of the well fluid entering the collection manifold from each of the plurality of subsea wells to thereby attempt to achieve the desired temperature and the desired water content, the calculator software calculates a mixing temperature of a mixture of the well fluid mixing in the collection manifold and calculates a water content of the mixture of the well fluid mixing in the collection manifold;

a plurality of flow control valves positioned between each of the plurality of wells and the collection manifold to control the flow rate of the well fluid entering the collection manifold; and a controller responsive to the calculator software to control the flow rate of the well fluid through each of the plurality of flow control valves by selectively actuating each of the plurality of flow control valves.

17. A system according to claim 16, wherein the calculator software calculates a volumetric flow rate, a specific heat capacity, and a density for a selected fluid of the well fluid from each of the plurality of subsea wells responsive to the sensed temperature value and the sensed pressure value.

18. A system according to claim 17, wherein the selected well fluid comprises oil, water, and gas for which the calculator software calculates the volumetric flow rate, the specific heat capacity, the density for each of the oil, water, and gas.

19. A system according to claim 16, further comprising a database in communication with the calculator software, the temperature sensor, and the pressure sensor, for the storage of sensed and calculated values from the calculator software, the temperature sensor, and the pressure sensor.

20. A system according to claim 16, wherein the controller comprises a valve actuation assembly that is remotely controlled from a vessel at a surface of a sea.

21. A system according to claim 16, further comprising a communications network placing the pressure and temperature sensors in communication with the calculator software.

22. A system according to claim 16, further comprising a communications network placing the controller in communication with the calculator software.

23. A system according to claim 16, wherein the pressure sensor and the temperature sensor is positioned between the plurality of flow control valves and the collection manifold.

24. A system according to claim 16, wherein:

the collection manifold comprises a plurality of headers that are each in fluid communication with each of the plurality of subsea wells;

the controller selectively controls the flow rate of the well fluid entering each of the headers of the collection manifold; and the calculator software being responsive to the well fluid inlet pressure value, the well fluid inlet temperature value, the desired temperature, and the desired water content for the mixture of well fluid exiting the collection manifold, to determine a selected flow rate of the well fluid entering each of the plurality of headers from each of the plurality of subsea wells to thereby attempt to achieve the desired temperature and the desired water content.

25. Software stored in a tangible computer medium located on a server, the software manages well fluid production from plurality of subsea wells feeding into a subsea collection manifold through a plurality of control valves regulating the flow of the well fluid from each of the plurality of subsea wells, the software comprising:

an operating conditions calculator to calculate a plurality of predetermined individual well fluid properties of the well fluid from each of the plurality of subsea wells and a plurality of well fluid properties of a mixture of the well fluid formed in the collection manifold when the well fluid from each of the plurality of subsea wells enters the collection manifold, the operating conditions calculator is responsive to a sensed temperature value and a sensed pressure value of the well fluid exiting each of the plurality of wells, to calculate a mixing temperature of a mixture of the well fluid in the collection manifold and a water content of the mixture of well fluid in the collection manifold; and a flow rate determiner responsive to comparing the properties of the mixture of the well fluid in the collection manifold and a predetermined set of values for well fluids exiting the collection manifold, to determine a selected flow rate of well fluid from each of the plurality of subsea wells.

26. Software according to claim 25, wherein the operating conditions calculator is responsive to a sensed temperature value and a sensed pressure value of the well fluid exiting each of the plurality of wells, to calculate a flow rate, a specific heat capacity, and a density for a selected fluid of the well fluid from each of the plurality of subsea wells.

27. Software according to claim 25, wherein the flow rate determiner is also responsive to the operating conditions calculator and the sensed temperature value and the sensed pressure value of the well fluid exiting each of the plurality of wells.

28. A method for managing production of well fluids from a collection manifold receiving well fluid from a plurality of subsea wells, comprising:

transmitting a sensed pressure and a sensed temperature from a well fluid output of each of the plurality of subsea wells through a communications network;

calculating a mixing temperature and a water content for a well fluid mixture formed in the collection manifold by the mixing of the well fluid from each of the plurality subsea wells responsive to the sensed pressure and sensed temperatures from each of the plurality of subsea wells;

determining a position for each of a plurality of flow control valves positioned between each of the plurality of wells and the collection manifold to control the flow rate of the well fluid entering the collection manifold from each subsea well in order to thereby achieve a desired temperature and a desired water content of the well fluid exiting the collection manifold.

29. A method according to claim 28, further comprising repeating the transmitting, calculating, and determining steps continuously during operations to thereby continue to achieve the desired temperature and the desired water content of the well fluid exiting the collection manifold responsive to changes in the sensed pressure and the sensed temperature from the well fluid output of each of the plurality of subsea wells.

30. A method according to claim 28, further comprising transmitting a sensed temperature value and a sensed pressure value of the well fluid exiting the collection manifold for comparison with the desired temperature and the desired water content of the well fluid exiting the collection manifold.

* * * * *

UNITED STATES PATENT AND TRADEMARK OFFICE

CERTIFICATE OF CORRECTION

PATENT NO. : 7,108,069 B2
APPLICATION NO. : 10/831480
DATED : September 19, 2006
INVENTOR(S) : Rune Killie et al.

It is certified that error appears in the above-identified patent and that said Letters Patent is hereby corrected as shown below:

Column 4, line 16, delete “the” before “risers 23”
Column 11, line 13, delete “21 f” and insert --211--
Column 20, line 20, after “subsea wells;” insert --and--

Signed and Sealed this

Thirtieth Day of January, 2007

JON W. DUDAS
*Director of the United States Patent and Trademark Office*